US005318369A

United States Patent [19]

Ishii

[11] Patent Number: 5,318,369

[45] Date of Patent: Jun. 7, 1994

[54] PROCESSING SYSTEM WITH PRINTER USING EXCHANGEABLE INK RIBBON

[75] Inventor: Hiroshi Ishii, Tokyo, Japan

[73] Assignee: Kabushiki Kaisha Toshiba, Tokyo, Japan

[21] Appl. No.: 622,272

[22] Filed: Dec. 6, 1990

Related U.S. Application Data

[63] Continuation of Ser. No. 442,392, Nov. 27, 1989, abandoned, which is a continuation of Ser. No. 291,231, Dec. 28, 1988, abandoned.

[30] Foreign Application Priority Data

Dec. 28, 1987 [JP] Japan ..... 62-334768

[51] Int. Cl.[5] ..... B41J 35/36

[52] U.S. Cl. ..... 400/249; 400/703; 400/279

[58] Field of Search ..... 400/120, 249, 208, 279, 400/692, 703

[56] References Cited

U.S. PATENT DOCUMENTS

| | | | |
|---|---|---|---|
| 4,224,628 | 9/1980 | Murray | 400/120 |
| 4,279,523 | 7/1981 | Ringle | 400/279 |
| 4,345,845 | 8/1982 | Bohnhoff et al. | 400/120 |
| 4,387,380 | 6/1983 | Asakura et al. | 400/474 |
| 4,676,679 | 6/1987 | Kondo | 400/54 |

FOREIGN PATENT DOCUMENTS

| | | | |
|---|---|---|---|
| 162078 | 9/1984 | Japan | 400/249 |
| 19577 | 1/1985 | Japan | 400/692 |
| 89389 | 5/1985 | Japan | 400/249 |
| 101075 | 6/1985 | Japan | 400/249 |
| 135282 | 7/1985 | Japan | 400/249 |
| 123572 | 6/1986 | Japan | 400/249 |

OTHER PUBLICATIONS

"End of Ribbon . . . " IBM Technical Disclosure Bulletin vol. 30, No. 7 pp. 267-268 Dec. 1987.

"Ribbon Fault Recovery . . . " IBM Technical Disclosure Bulletin vol. 29, No. 6 p. 2518 Nov. 1986.

Long et al. "Operator Selectable . . . Indicator" IBM Tech. Disclosure Bulletin vol. 27, No. 6 pp. 3191-3192 Nov. 1984.

Japanese Patent Disclosure (Tokkai-Sho) No. 58-173691, Oct. 12, 1983.

Japanese Patent Disclosure (Tokkai-Sho) No. 58-59886, Apr. 9, 1983.

*Primary Examiner*—David A. Wiecking

*Attorney, Agent, or Firm*—Cushman, Darby & Cushman

[57] ABSTRACT

The processing system described by the invention comprises a memory means for storing print information and a printer for printing the print information stored in the memory means. The printing means using exchangeable printing material to print the print information. The printer has a detector which detects when the printing material is used up. The processing system further includes a controller for controlling the printer which in response to the detection of the using-up of the printing material, stops the printer. After the used-up printing material is exchanged, the controller restarts the printer and the remaining portion of the print information is printed, connected to the earlier portion in a smooth manner and that there is no evidence of the interruption. print information when the printing material is used up in the middle of the printing of the print information. The controller restarts the printer to print the remaining portion of the print information in connection to the portion of the print information has been printed after the used-up printing material is exchanged.

35 Claims, 11 Drawing Sheets

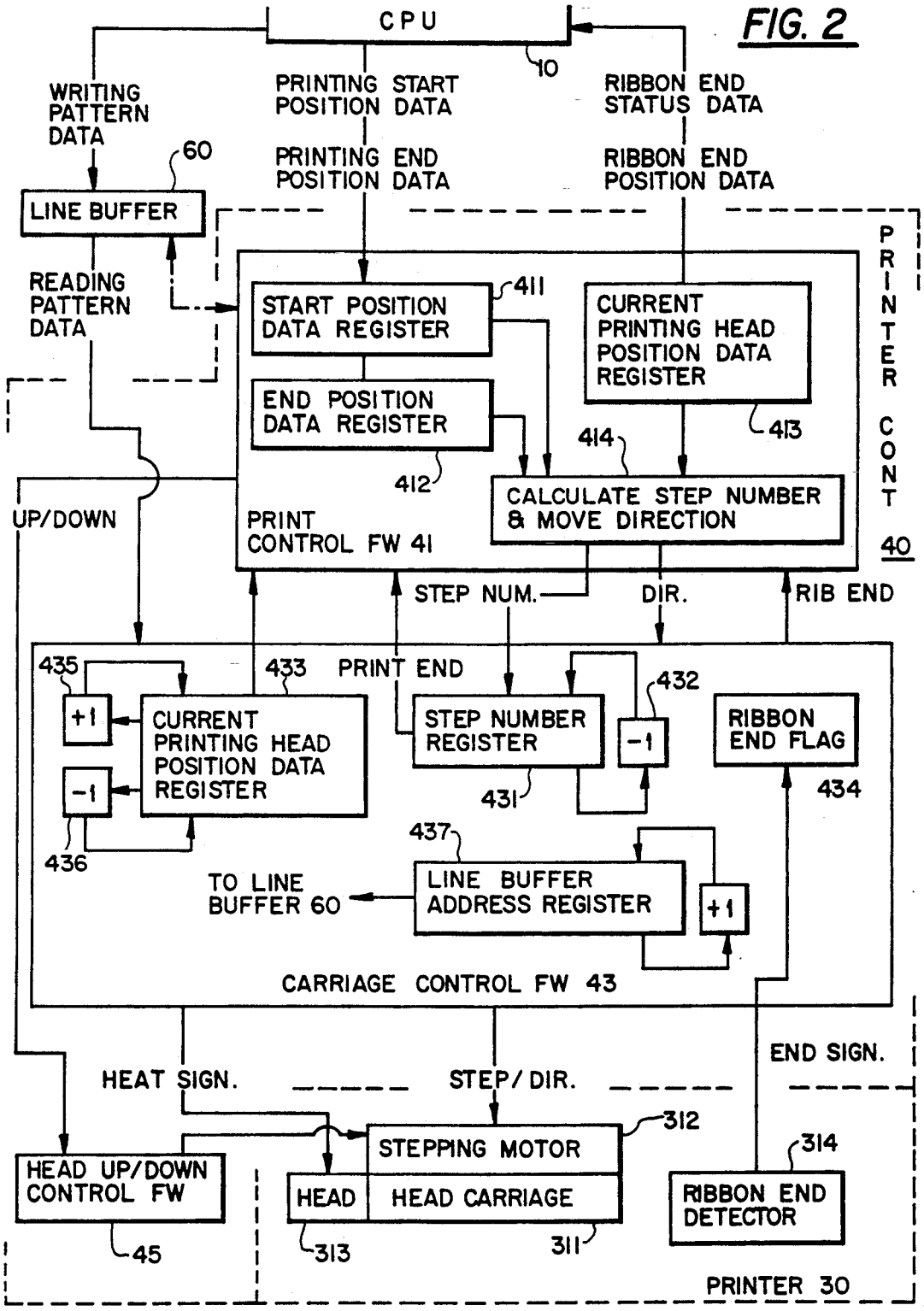
FIG. 2
CPU
10
WRITING PATTERN DATA
PRINTING START POSITION DATA
RIBBON END STATUS DATA
60
PRINTING END POSITION DATA
RIBBON END POSITION DATA
LINE BUFFER
READING PATTERN DATA
START POSITION DATA REGISTER
411
CURRENT PRINTING HEAD POSITION DATA REGISTER
END POSITION DATA REGISTER
413
414
412
CALCULATE STEP NUMBER & MOVE DIRECTION
PRINT CONTROL FW 41
PRINTER CONT 40
UP/DOWN
STEP NUM.
DIR.
RIB END
435
433
PRINT END
432
+1
CURRENT PRINTING HEAD POSITION DATA REGISTER
STEP NUMBER REGISTER
-1
RIBBON END FLAG
-1
431
434
436
437
TO LINE BUFFER 60
LINE BUFFER ADDRESS REGISTER
+1
CARRIAGE CONTROL FW 43
END SIGN.
HEAT SIGN.
STEP/DIR.
312
STEPPING MOTOR
314
HEAD UP/DOWN CONTROL FW
HEAD
HEAD CARRIAGE
RIBBON END DETECTOR
45
313
311
PRINTER 30

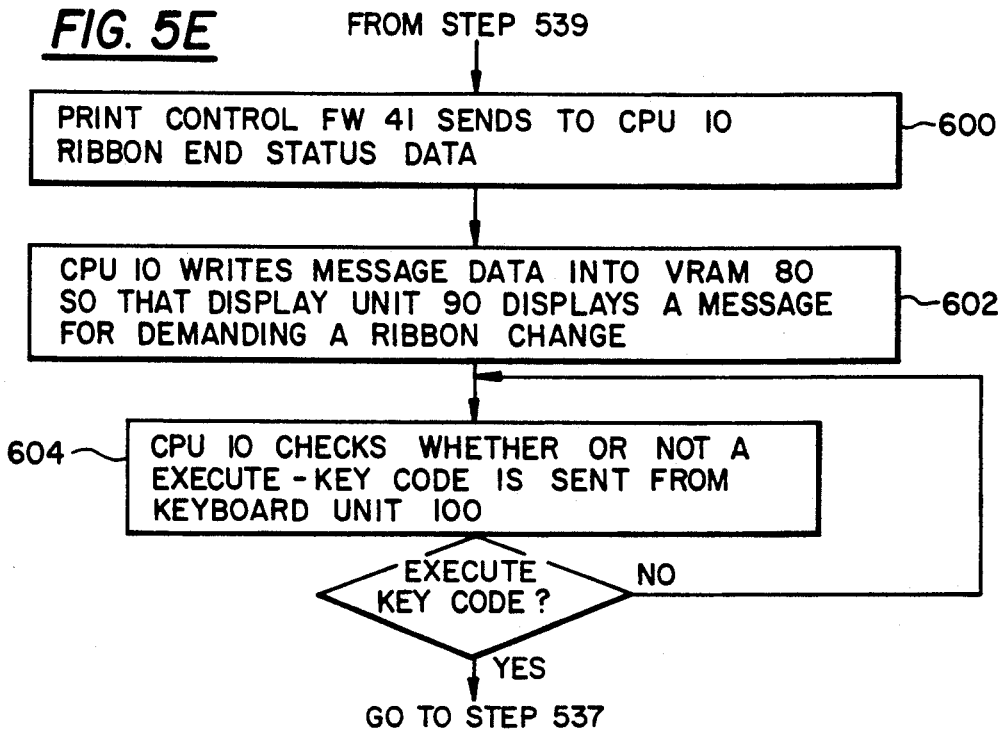
FIG. 5E
FROM STEP 539
PRINT CONTROL FW 41 SENDS TO CPU 10 RIBBON END STATUS DATA
600
CPU 10 WRITES MESSAGE DATA INTO VRAM 80 SO THAT DISPLAY UNIT 90 DISPLAYS A MESSAGE FOR DEMANDING A RIBBON CHANGE
602
604
CPU 10 CHECKS WHETHER OR NOT A EXECUTE-KEY CODE IS SENT FROM KEYBOARD UNIT 100
EXECUTE KEY CODE ?
NO
YES
GO TO STEP 537

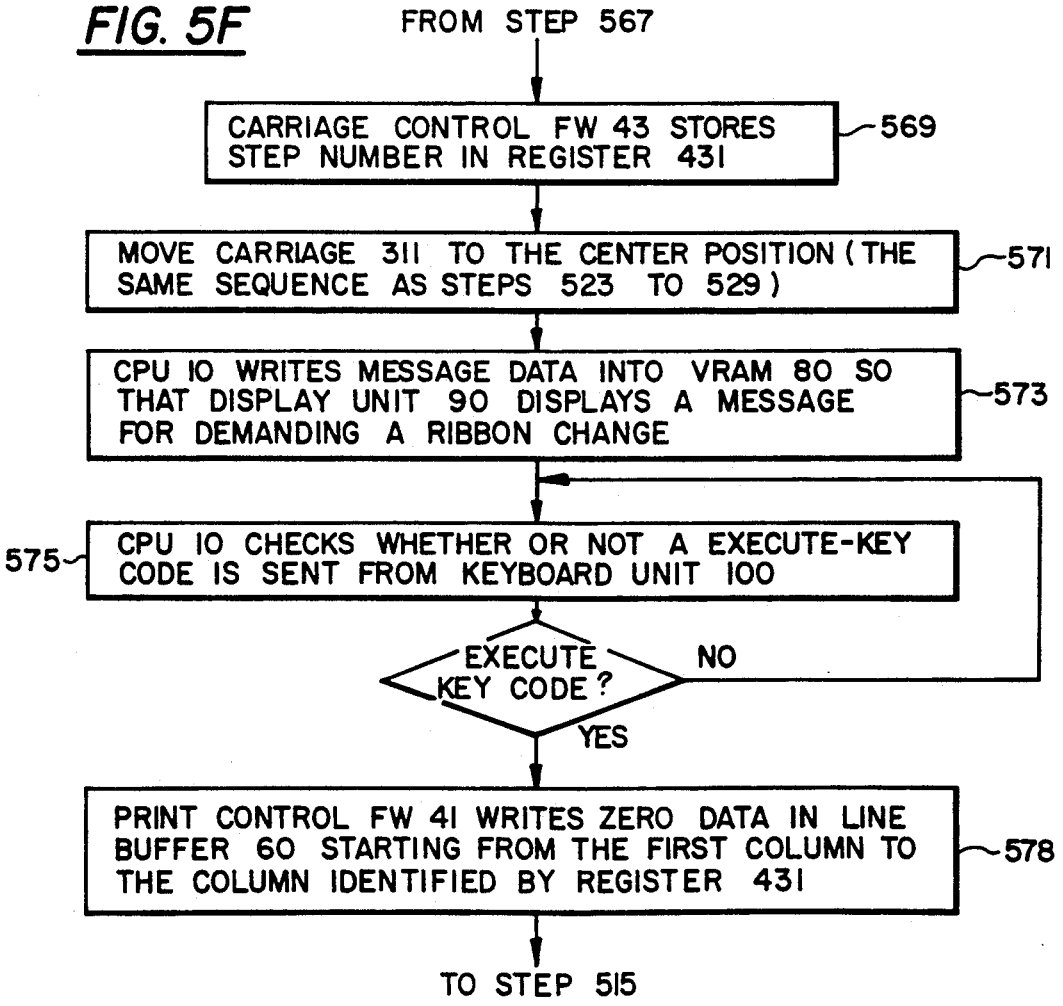
FIG. 5F
FROM STEP 567
CARRIAGE CONTROL FW 43 STORES STEP NUMBER IN REGISTER 431
569
MOVE CARRIAGE 311 TO THE CENTER POSITION (THE SAME SEQUENCE AS STEPS 523 TO 529)
571
CPU 10 WRITES MESSAGE DATA INTO VRAM 80 SO THAT DISPLAY UNIT 90 DISPLAYS A MESSAGE FOR DEMANDING A RIBBON CHANGE
573
575
CPU 10 CHECKS WHETHER OR NOT A EXECUTE-KEY CODE IS SENT FROM KEYBOARD UNIT 100
EXECUTE KEY CODE ?
NO
YES
PRINT CONTROL FW 41 WRITES ZERO DATA IN LINE BUFFER 60 STARTING FROM THE FIRST COLUMN TO THE COLUMN IDENTIFIED BY REGISTER 431
578
TO STEP 515

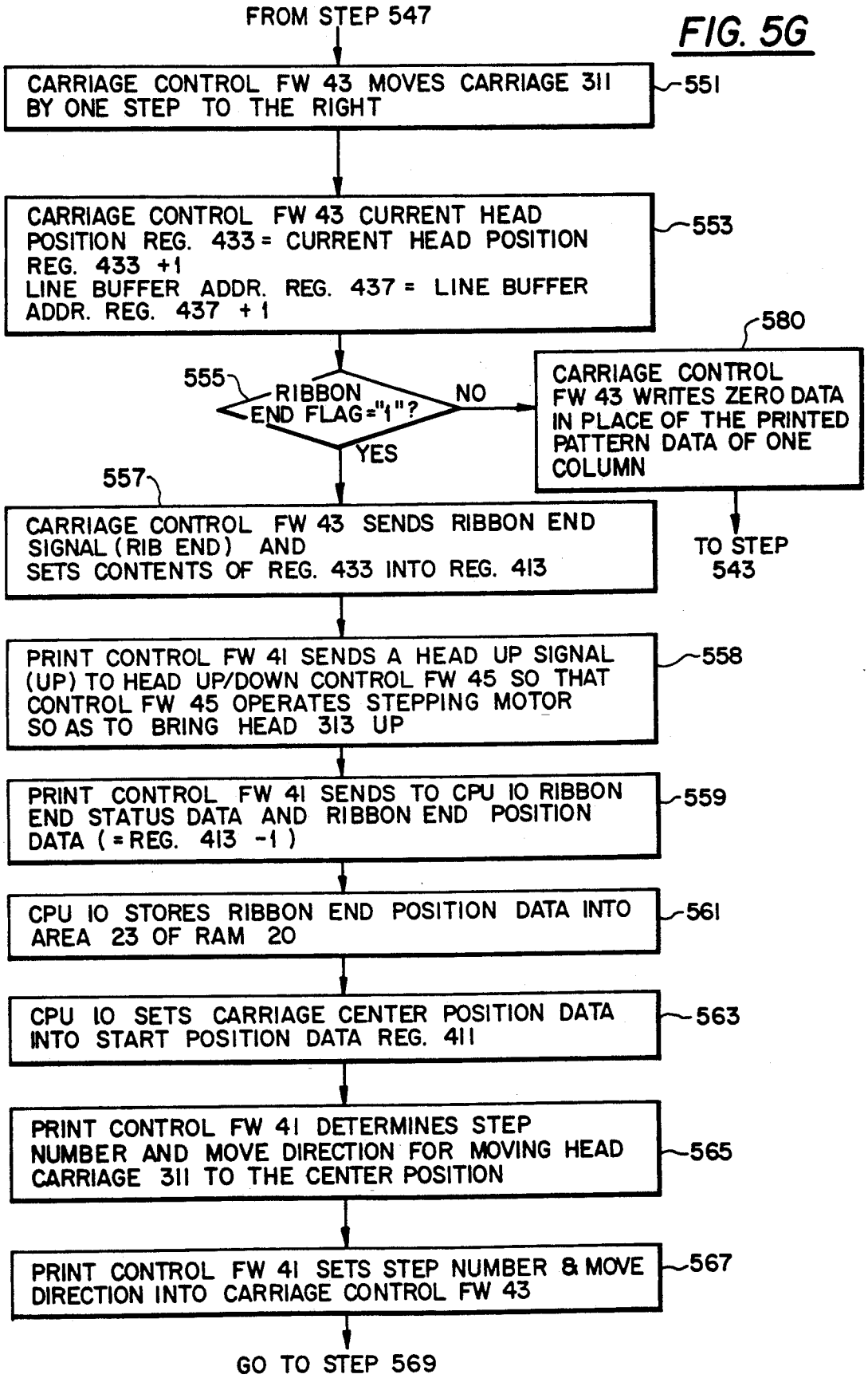
FROM STEP 547
FIG. 5G
CARRIAGE CONTROL FW 43 MOVES CARRIAGE 311 BY ONE STEP TO THE RIGHT
551
CARRIAGE CONTROL FW 43 CURRENT HEAD POSITION REG. 433 = CURRENT HEAD POSITION REG. 433 +1
LINE BUFFER ADDR. REG. 437 = LINE BUFFER ADDR. REG. 437 + 1
553
580
555
RIBBON END FLAG="1"?
NO
YES
CARRIAGE CONTROL FW 43 WRITES ZERO DATA IN PLACE OF THE PRINTED PATTERN DATA OF ONE COLUMN
TO STEP 543
557
CARRIAGE CONTROL FW 43 SENDS RIBBON END SIGNAL (RIB END) AND SETS CONTENTS OF REG. 433 INTO REG. 413
PRINT CONTROL FW 41 SENDS A HEAD UP SIGNAL (UP) TO HEAD UP/DOWN CONTROL FW 45 SO THAT CONTROL FW 45 OPERATES STEPPING MOTOR SO AS TO BRING HEAD 313 UP
558
PRINT CONTROL FW 41 SENDS TO CPU 10 RIBBON END STATUS DATA AND RIBBON END POSITION DATA (=REG. 413 -1)
559
CPU 10 STORES RIBBON END POSITION DATA INTO AREA 23 OF RAM 20
561
CPU 10 SETS CARRIAGE CENTER POSITION DATA INTO START POSITION DATA REG. 411
563
PRINT CONTROL FW 41 DETERMINES STEP NUMBER AND MOVE DIRECTION FOR MOVING HEAD CARRIAGE 311 TO THE CENTER POSITION
565
PRINT CONTROL FW 41 SETS STEP NUMBER & MOVE DIRECTION INTO CARRIAGE CONTROL FW 43
567
GO TO STEP 569

PROCESSING SYSTEM WITH PRINTER USING EXCHANGEABLE INK RIBBON

This is a continuation of application Ser. No. 07/442,392, filed on Nov. 27, 1989, which was abandoned upon the filing hereof and which was a continuation of application Ser. No. 07/291,231, filed Dec. 28, 1988, abandoned Nov. 27, 1989.

BACKGROUND OF THE INVENTION

1. Field of the Invention

The present invention relates to a processing system, such as a work processor, which has a printer using an exchangeable ink ribbon which prints documents including characters, symbols, ruled lines or graphic patterns.

2. Description of Related Prior Arts

In a processing system such as a word processing system, a printer is used for printing such things as characters, symbols, and graphic patterns on material such as a sheet of paper. The printer often uses a one-time ink ribbon incorporated within a cassette. For example, as described in U.S. Pat. No. 4,387,380, a thermal transfer printing system uses the one-time ink ribbon cassette wherein a ribbon tape of polyester is coated with pigment or dye such as carbon black which is dispersed in a heat fusible binder.

When using the one-time ink ribbon for printing, the ink ribbon must be exchanged for a new one once it has been exhausted from the leading through trailing ends. Therefore the printer using such one-time ink ribbon usually includes a ribbon-end detector which detects the trailing end of the ink ribbon (hereinafter called "the end of the ink ribbon" for short) Upon such detection printing stops, to stop printing and the processing system asks the operator to exchange the ink ribbon for a new one, since that ink ribbon has been used up. One type of ribbon-end detector having photo couplers is described in U.S. Pat. No. 4,387,380; another type of ribbon-end detector is disclosed in Japanese patent (Tokkai-Sho) No. 58-59886.

One example, includes coating the base film of the end portion of the ink ribbon. The pigment-coated portion of the ribbon cannot reflect light, but the metal-coated portion can. In the printer a luminous diode, acting as a light source and a photo transistor, acting as a light sensor are provided so that the photo transistor can sense light from the luminous diode reflected by the metal coated portion of the ink ribbon. A sense signal is only generated when the ink ribbon has been used up and the metal-coated portion of the ribbon comes in front of the luminous diode. The printing system then recognize the exhaustion of the ink ribbon and then stop printing The operator can now exchange the exhausted ink ribbon, or ink ribbon cassette, for a new one.

In a conventional processing system, however, when the ink ribbon is used up and replaced in the middle of printing a line in a document page, the document must be printed again from a print-start position as the top of the page of the start of the unfinished line. The sheet where a portion of the document page had already been printed must be thrown away, and a new sheet inserted.

SUMMARY OF THE INVENTION

It is an object of the present invention to provide a processing system with a printer using an exchangeable printing material wherein when the printing material has been used-up and the printing is stopped at a middle position in a line, the printing can be resumed from that middle position, once the used-up printing material has been exchanged for a fresh one such that the portion of the line having already been printed is accurately joined to the remaining portion.

It is a further object of the present invention to provide processing system with a printer using an exchangeable printing material wherein when the printing material has been used-up and the printing material is changed for a new one, the used-up printing material is easily changed.

BRIEF DESCRIPTION OF THE DRAWINGS

Other objects and features of the invention will become apparent from the following description, given in connection with the accompanying drawings, in which:

FIG. 2 shematically illustrates operations of a printer controller and a printer of the word processing system shown in FIG. 1;

FIGS. 5A to 5G are flowcharts illustrating operations of the word processing system in printing a line of a document on a sheet;

DETAILED DESCRIPTION OF THE PREFERRED EMBODIMENTS

Figure 1:
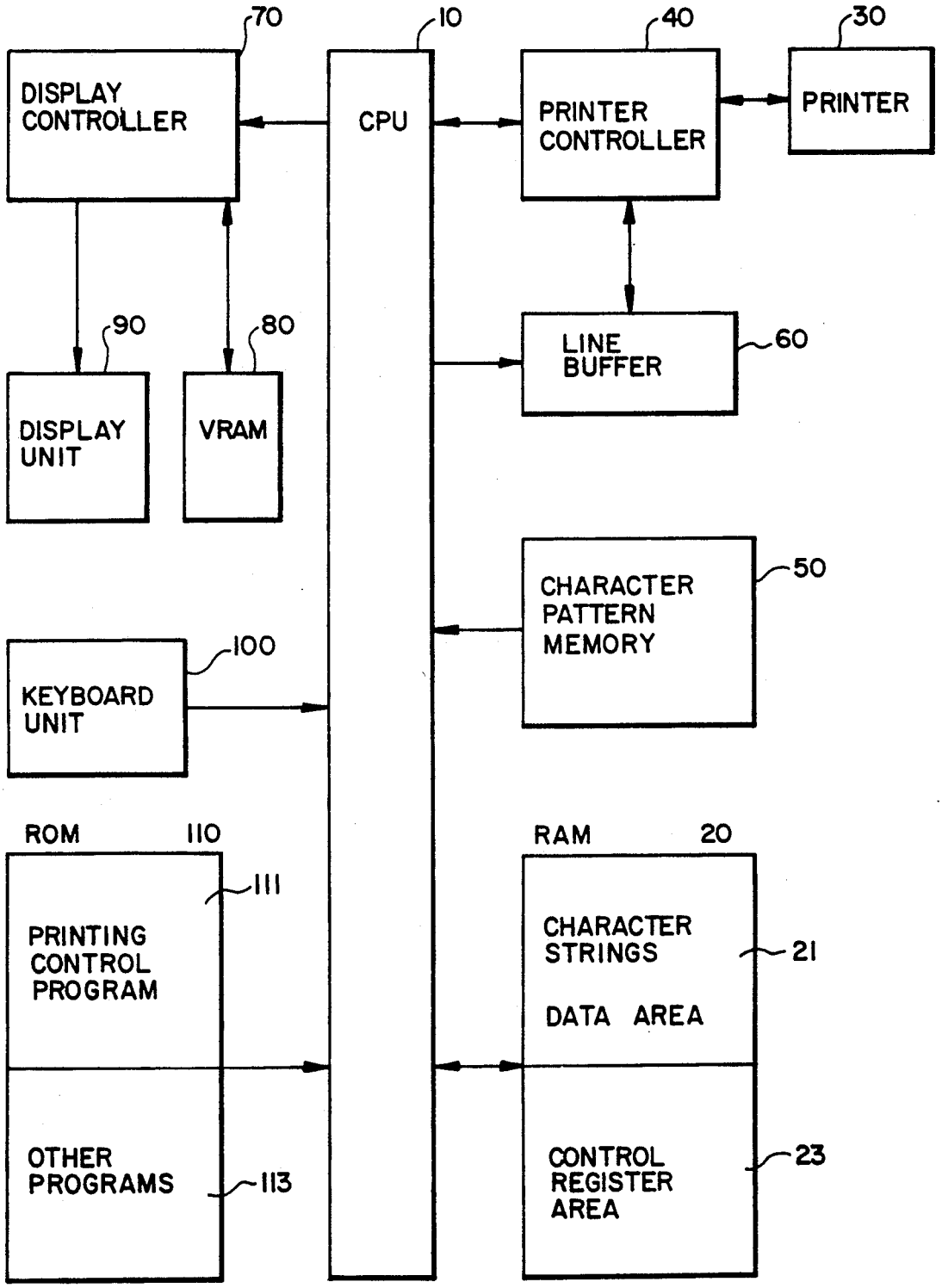
FIG. 1 illustrates a schematic block diagram of a word processing system according to the present invention showing constitution of the processing system.

FIG. 1 shows constitution of a word processing system embodying the present invention.

The word processing system includes a central processing unit (CPU) or microprocessor 10 for controlling system operations executed thereby to making, editing, and printing the document.

ROM 110, connected to CPU 10 through a bus line, stores programs for such operations to be executed by CPU 10. A print control program for controlling printing of the document on sheets of paper, which especially relates to the present invention, is stored in area 111 of ROM 110. The other programs for controlling the other system operations are stored in area 113 of ROM 110. Since these programs may be programs used in currently sold word processors, explanation thereof is omitted.

Keyboard unit 100 is also connected to CPU 10 by the bus line and is used to input character codes, command codes, and other document data for graphic pattern or ruled lines, into the word processing system. Keyboard unit 100 includes character keys and control keys (both not shown in FIG. 1). The character keys corresponds to alphabet letters, numerals and miscellaneous symbols such as "$", "%" or "(". The character keys are used to input the characters which constitute a document into the processing system. The control keys includes cursor control keys, an execute key and, some command keys used in executing editing operations, such as deleting, copying, or moving a character string. When a key on keyboard unit 100 is pushed down, keyboard unit 100 generates a key code corresponding to the key and sends the key code to CPU 10. Keyboard unit 100 may be a keyboard unit described in U.S. Pat. No. 4,609,908. In this embodiment, the execute key is used in changing an exhausted ink ribbon.

RAM 20 is also connected to CPU 10 through the bus line and stores the character codes and the document data input from keyboard unit 100. The character codes and the document data constituting a document are stored in the character strings data area 21 of RAM 20. RAM 20 further includes control register area 23 for storing control data which is necessary to print the document according to the present invention.

Figure 3:
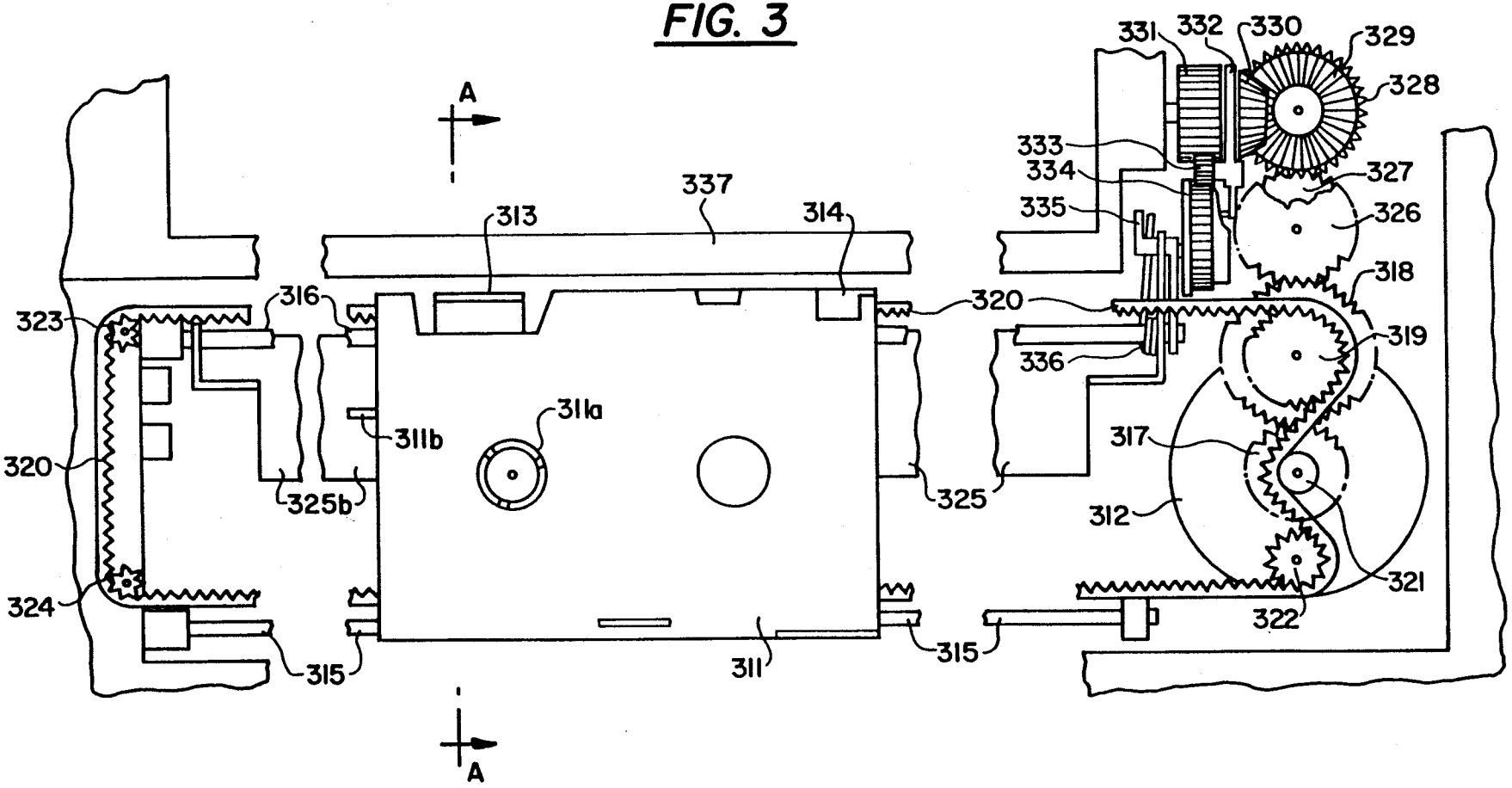
FIG. 3 is a partial plan view of the printer illustrating a driving mechanism of a carriage and a printing head of the printer shown in FIG. 2.
Figure 4:
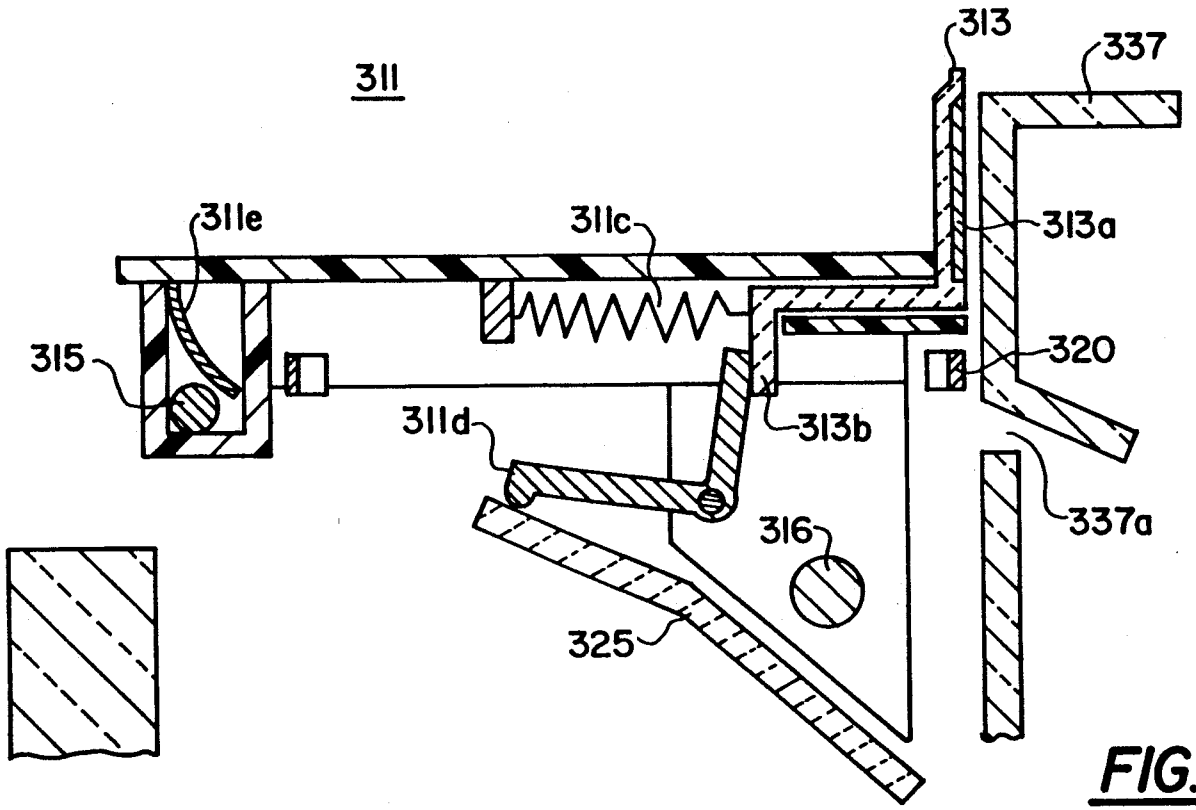
FIG. 4 is a sectional view taken on line A—A of FIG. 3.
Figure 5A:
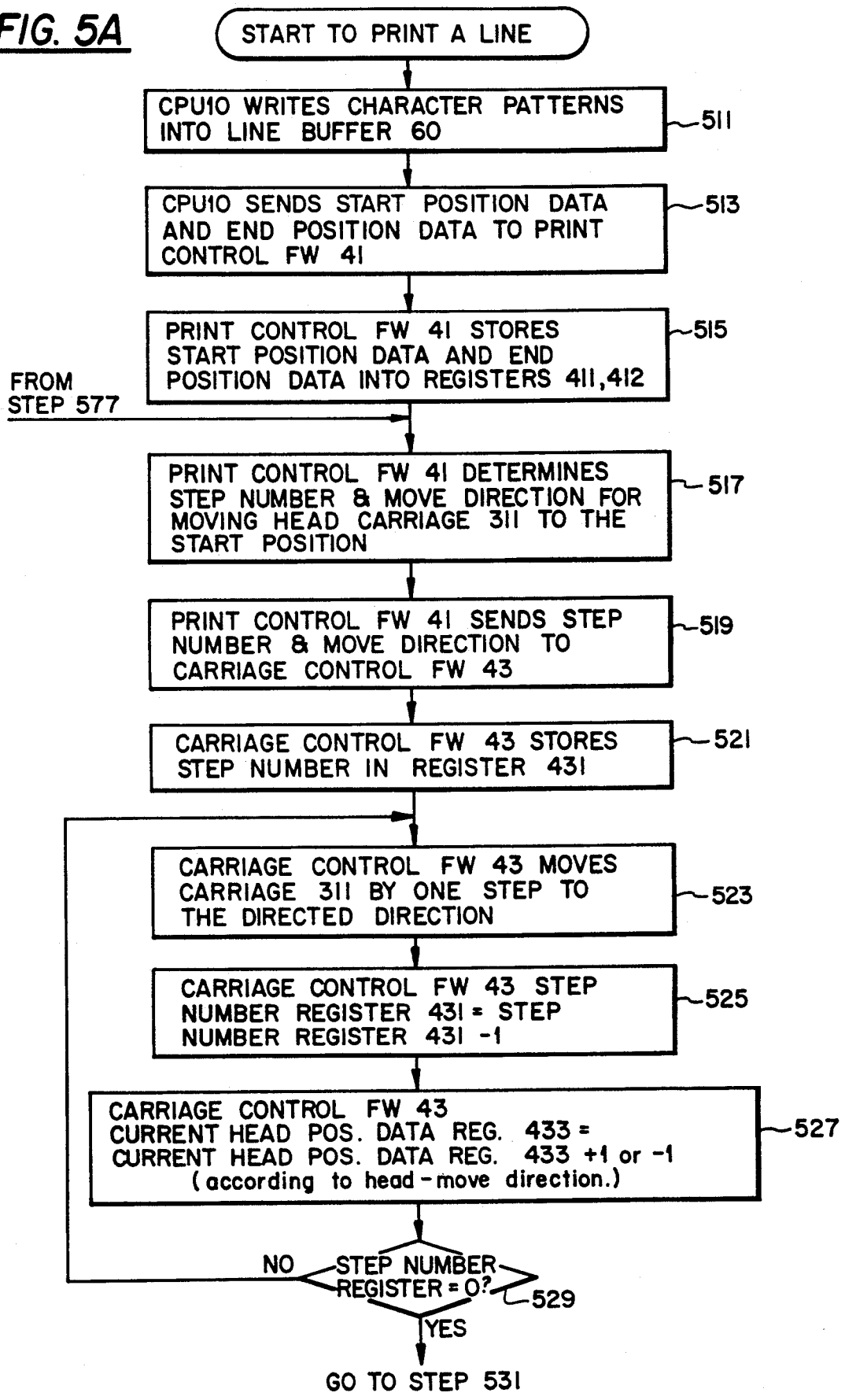
Figure 5B:
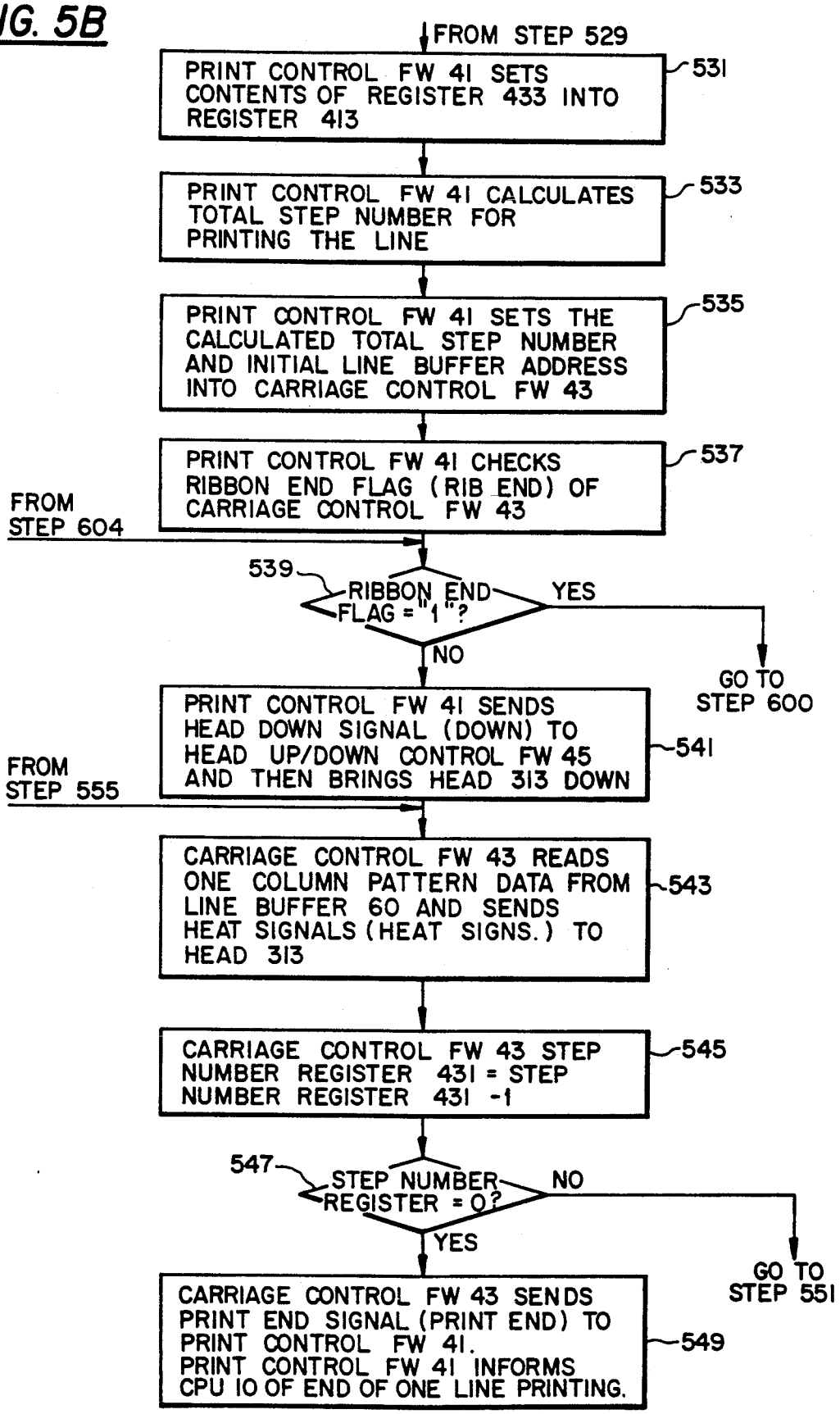
Figure 5C:
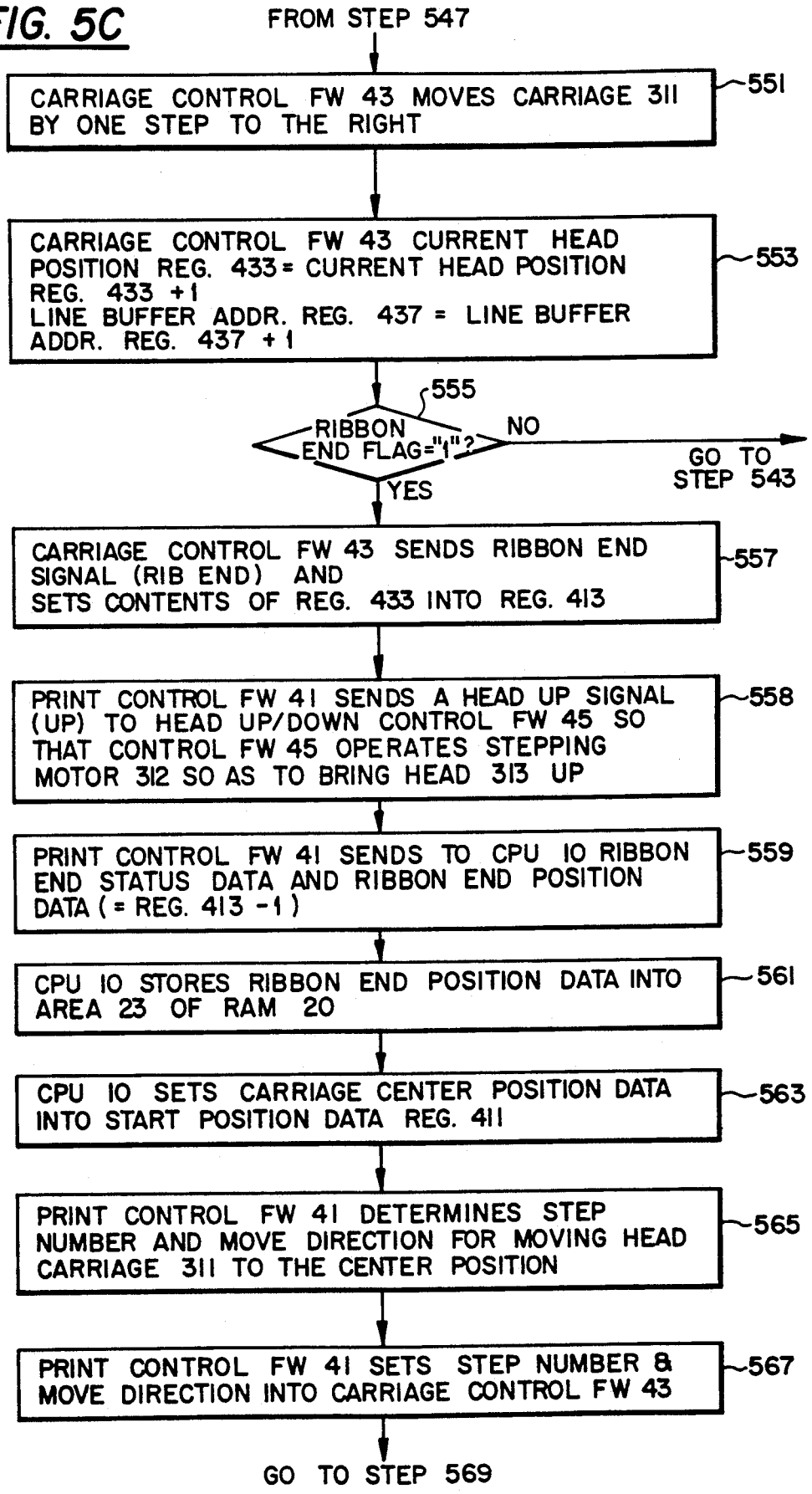
Figure 5D:
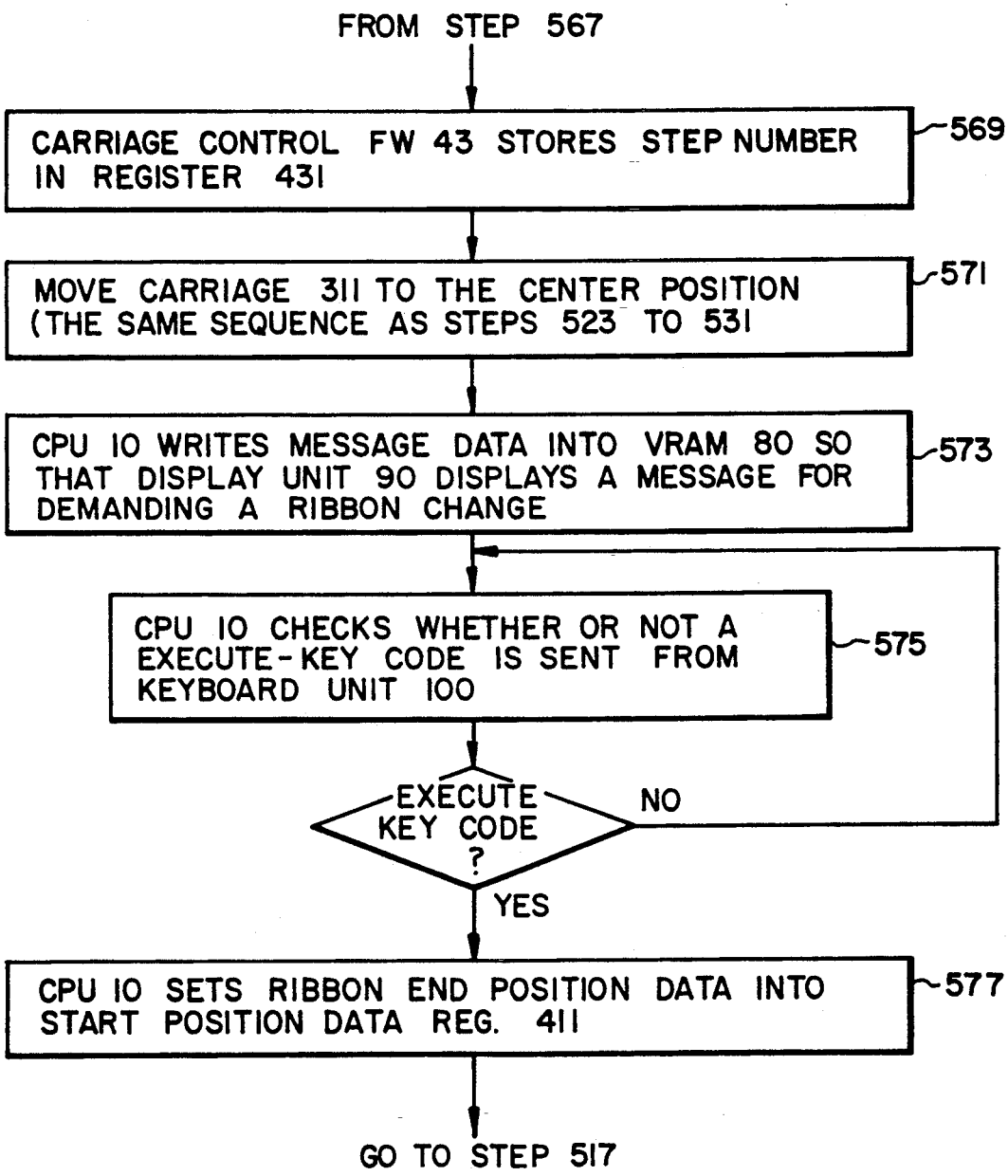

Printer 30 is connected to CPU 10 through printer controller 40. The bus line connects printer controller 40 to CPU 10. Printer 30 may be a thermal transfer printer as described in U.S. Pat. No. 4,387,380 and U.S. Pat. No. 4,712,115. FIG. 3 shows a partial plan view of the printer 30, and FIG. 4 shows a sectional view taken on line A—A of FIG. 3. Printer 30 includes carriage 311 which carries a ink ribbon cassette. The ink ribbon cassette may be the ink ribbon cassette shown in U.S. Pat. No. 4,712,115. The ink ribbon cassette includes two reels rotatably mounted therein. A film of polyester coated with pigment starts fully wound around one reel and as the film is used up, it winds around the other reel, which contains the exhausted portion of the ribbon. As mentioned above, the end of the film is coated with metal to permit detection of the ribbon end. The ink ribbon cassette is mounted on carriage base plate 311*c*. Then, rotatable reel drive shaft 311*a* is inserted into the reel for the exhausted ribbon portion so that this reel can be rotated by shaft 311*a* and then wind the exhausted ribbon portion up.

Head support plate 313 with a thermal printing head 313*a* mounted thereon is disposed on carriage 311. Thermal printing head 313*a* faces platen 337 of printer 30. The ink ribbon passes from the right to the left in FIG. 3 between platen 337 and thermal printing head 313*a*. A sheet of paper fed out of space 337*a*, on which the patterns are printed by printing head 313*a* and, passes upwardly in FIG. 4 through the space between the ink ribbon (if the ribbon cassette is attached to carriage) and platen 337. The sheet is fed by a paper feed motor. Since the paper feed mechanism is well known, as shown in U.S. Pat. No. 4,712,115, the paper feed mechanism is omitted from FIGS. 3 and 4.

Thermal printing head 313*a* includes eight thermal pins arranged in a column (normal to the feed direction of the ink ribbon) each of which is heated, in response to a received heat signal (HEAT SIGN. shown in FIG. 2) which melts the pigment on the film and then putts the melted pigment to the sheet, where it concretes. By delivering the heat signals to the thermal pins, as many as eight dots in a column can be simultaneously printed on the sheet. These are explained in more detail in U.S. Pat. No. 4,387,380.

As shown in FIGS. 3 and 4, Carriage 311 is supported by guide shaft 315 and 316. A base of carriage 311 is pushed toward guide shaft 315 by the leaf spring 311*e*, preventing carriage 311 from wobbling. In addition, the front portion of carriage 311 is fixed to the ring-shaped flexible belt 320, which has notches on its inner surface. Belt 320 is stretched among spur gears 319, 322, 323, 324 and pulley 321 mounted on a drive shaft of stepping motor 312. Notches of gears 319, 322, 323 and 324 are engaged with those of belt 320. Spur gear 317 is mounted on the drive shaft of stepping motor 321. Spur gear 318 which gears with gear 317, is mounted concentrically beneath gear 319. Thus, since the driving force generated by stepping motor 312 is transmitted to belt 320 attached to carriage 311 through gears 317, 318 and 319, stepping motor 312 can move carriage 311 forward and backward along guide shafts 315 and 316. Stepping motor 312 receives its step/direction signals (STEP/-DIR.) from the carriage control firmware(FW) 43. The STEP signals define the number of steps by which stepping motor 312 rotates. The DIR. signals define the direction in which stepping motor 312 rotates. So, the magnitude and direction of carriage movement are controlled by the STEP/DIR. signals of the carriage control FW.

As shown in FIG. 4, head support plate 313 is forced in a direction away from platen 337 by spring 311*c* connected between carriage 311 and head support plate 313. Head support plate 313 can be moved toward and away from platen 337 by the head up/down mechanism mentioned below. When head support plate 313 with head 313*a* is moved toward platen 337, head 313*a* pushes the ink ribbon and the sheet against platen 337. Then, since an ink layer of the ink ribbon comes into contact with the sheet, the ink or pigment selectively melted by the heat pin of head 313*a* is transferred onto the sheet. Therefore, by scanning carriage 311 with printing head 313*a* from left to right in FIG. 3 without the sheet feed, dot patterns of a line, the column of which includes eight dots, can be printed. "To move the head 313*a* toward platen 337" is hereinafter referred to as "to bring head 313*a* down". "To move the head 313*a* away from platen 337" is hereinafter referred to as "to bring head 313*a* up".

The head up/down mechanism includes head up/-down plate 325 and L-shaped plate 311*d*. As shown in FIG. 3, head up/down plate 325 can swing upwardly and downwardly about guide shaft 316. Coil spring 336 wound around shaft 316 forces head up/down plate 325 upwardly. A tab of head up/down plate 325 is hung on bar 335, which is rotatable about shaft 316. Bar 335 has a projecting portion which engages with a recess spirally engraved on one side surface of gear 334. When gear 334 is rotated, bar 335 goes upwardly or downwardly, as the projecting portion follows the spiral recess of gear 334, and moves head up/down plate 325 upwardly or downwardly. When plate 325 moves upwardly, L-shaped plate 311*d* rotates clockwise in FIG. 4 and pushes head support plate 313 toward platen 337. In contrast, when head up/down plate 325 goes down, because of spring 311*c*, head support plate 313 is shifted away from platen 337, and thus plate 311*d* is returned counterclockwise. Gear 334 is also driven by spindle motor 312. The motion of spindle motor 312 is transmitted to bevel gear 329 through spur gears 317, 318, 326, 327, 328 all of whom engage with one another. Since bevel gear 329 gears into another bevel gear 330, gear 331 fixed on the same shaft as bevel gear 330 can be rotated by stepping motor 312. Plate 332, with gears 333, is mounted on the shaft of gear 330, movable in relation to gears 330 and 331. In FIG. 3, one of the gears 333 is located behind gear 331. Depending on the direction of the rotation of stepping motor 312, either of the gears 333 is brought into contact with gear 334. The notched surface of gear 334 is partially scraped. If gear 334 continues to be rotated by either of gears 333 now contact with it those same gears 333 is brought into contact with the scraped portion of gears, and thus slips over gear 334. So the rotation of stepping motor 312 can control the head up/down movement both with the connection between gears 333 and gear 335, and with the movement of bar 335 following the spiral recess on gear 334. And thus, head up/down control firmware(FW) can control the head up/down mechanism to bring head support plate 313 up or down by sending adequate STEP/DIR. signals to stepping motor 312. In place of the above mentioned head up/down mechanism, a mechanism disclosed in U.S. Pat. No. 4,712,115 may be applied to this embodiment.

As shown in U.S. Pat. No. 4,712,115, the ink ribbon is wound up by the reel which is driven by shaft 311*a* of carriage 311 only when carriage 311 shifts to the right in FIG. 3 with head support plate 313 being brought down. This ribbon wind-up operation is performed by a gear mechanism (not shown in FIG. 3) wherein a gear, rotating drive shaft 311*a* counterclockwise in FIG. 3, receives a force for rotation from belt 315. After one column of dots have been printed by head 313*a*, the exhausted ribbon portion is shifted to the left by the rotation of the reel on drive shaft 311*a* while stepping motor 312 moves carriage 311 to the right by one step with head supporting plate 313 being brought down.

The luminous diode and the photo transistor of the above-mentioned ribbon end detector are arranged in a portion 314 of carriage 311 as shown in FIG. 3, such that the photo transistor can detect the light from the luminous diode reflected by the metal-coated ribbon end portion. As shown in FIG. 2, the ribbon end signal (END SIGN.) generated by the photo transistor is sent to flip-flop 434 which sets a ribbon end flag. When the ribbon end flag is "1", it indicates that the whole ink ribbon, in the cassette now mounted on carriage 312, is used up and must be replaced.

Returning to FIG. 1, display controller 70, video RAM (VRAM) 80 and display unit 90 are connected to CPU 10 for visually displaying the document data stored in character strings data area 21 of RAM 20 and messages from the programs. Since display controller 70, VRAM 80 and display unit 90 are all well known, detailed description is ommitted.

Referring to FIG. 2 and FIGS. 5A to 5G, the operations of printer controller 40 will be explained in detail. FIG. 2 shows shematic operational block diagrams of the system. FIG. 5 shows an operational flow chart of the system in printing a line of a document. The operations of printer controller 40 are achieved by three firmware programs (FW) executed by a microprocessor in printer controller 40, print control FW 41, carriage control FW 43 and head up/down control FW 45. Print control FW uses start position data register 411, end position data register 412 and current printing head position data register 413, and determines the number of steps and the carriage move direction for moving carriage 311 to a desired position according to the contents of registers 411, 412 and 413.

Figure 6A:
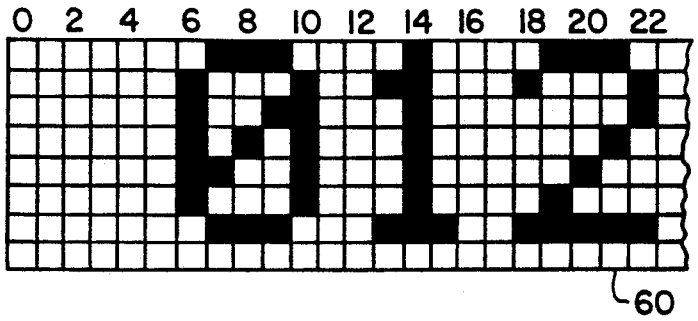
FIG. 6A illustrates contents of a line buffer shown in FIGS. 1 and 2 when sample character patterns of a line are printed on a sheet of paper by the word processing system.

When printing the document stored in RAM 20, CPU 10 reads character code data in a line out of RAM 20 line by line, and then reads the corresponding character dot pattern data out of pattern memory 50. The dot pattern data in the line are written into line buffer 60 by CPU 10 in such a way shown in FIG. 6A (STEP 511). In the case of printing graphical patterns, such as ruled lines, CPU 10 generates dot patterns of a line forming the graphical pattern according to the graphical pattern data stored in RAM 20, and writes the generated dot patterns of the line into line buffer 60. In this embodiment, one addressed word of line buffer 60 corresponding to one column of the line includes eight bits; line buffer 60 has about 1,500 words.

CPU 10 sets the printing start position data and the end position data into registers 411 and 412, respectively (STEPS 513, 515). The start position data define a start position of carriage 311 where head 311*a* is brought down and the printing of the dot pattern data of a line stored in line buffer 6 is begun. In the example shown in FIG. 6A, the start position data indicates the address [6] of line buffer 60. The end position data defines the end position of the carriage where the printing of the line is finished. Now, the end position data in register 412 indicates the address [22] of line buffer 60. In place of steps 5 13 and 515, print control FW 41 itself may check all words of line buffer 60, from the first word (address 0) to the last word (address 1500), and determine the address of the word where the dot pattern data of a column is first read out as the start position data and another address of the word where the dot pattern data of a column is last read out as the end position data. The current printing head position data is stored in register 413. This data stored in register 413 indicates the present position of carriage 311. As shown in FIG. 3, printer 40 has a carriage zero position detector, including luminous diode 338 and photo transistor 339, which receives light from the luminous diode on the left inner side. Carriage 311 includes, projecting portion 311*b* which enters between luminous diode 338 and photo transistor 339 and interrupts the light from luminous diode 338 when carriage 311 is fully moved to the left, i.e. the zero position. In response to the cutting-off of the signal from photo transistor 339 the contents of register 413 are reset to zero. Afterwards, the contents of r 413 are renewed according to the movement of carriage 311. The current printing head position data, stored in register 413, indicates the present position of carriage 311. Print control FW 41 uses the current printing head to position data and the start position data (Step 17) to determine the number of steps and the direction of movement for moving carriage 311, with head 311*a*, to the printing start position. In step 517, FW 41 subtracts the start position data from the current head position data. The absolute value of the subtraction result corresponds to the required number of steps, while the sign corresponds to the required direction of movement, i.e. minus "−" to the right direction and plus "+" to the left. FW 41 then delivers the determined step number data (STEP NUM.) and direction data (DIR.) into carriage control FW 43 (STEP 519). After the STEP NUM. data has been stored in step number register 431 to be used by FW 431 (STEP 521), carriage control FW 43 starts to be executed.

By executing from step 423 through step 529 until the data stored in register 431 become zero, carriage 311 is brought to the start position where the printing of pattern data store din line buffer 60 is to begin. In this sequence the contents of the step number register 431 is decremented by one (STEP 525) whenever carriage 311 is moved by one step (STEP 523). The contents of the current printing head position data register 433 are simultaneously either incremented or decremented by one in accordance with the direction of the carriage movement (STEP 527) (i.e. "+1" for right movement and "−1" for left movement). Current printing head position data register 433 of carriage control FW 43, which is reset in the same way as register 413 of print control FW 413, stores the current head position data computed according to the carriage movement. So the data stored in register 433 always indicates where carriage 311 now is. In step 529, when the contents of register 431 are checked, if the stored data is a "0", that is, if carriage 311 has been positioned on the start position, then step 531 is executed. If not, then step 523 is executed again. After carriage 311 has been positioned on the start position, the contents of register 433 are loaded into register 413 used by print control FW 41 (STEP 531). Then data stored in register 413 now indicates the current carriage/head position.

Next, print control FW 41 calculates the total number of steps of the carriage movement required, for printing all the pattern data stored in line buffer 60, by subtracting the start position data in register 411 from the end position data in register 412 (STEP 533). Print control FW 41 then loads the calculated number of steps and the initial line buffer address data corresponding to the start position data in register 412 into registers 431 and 437. Since the printing by head 313*a* is performed from the left to the right of the sheet in printer 30, the DIR. signal is set so as to indicate the right direction. The initial line buffer address data stored in register 437 define an address of the word where a column of pattern data is first stored (i.e. [6] in the example shown in FIG. 6A).

The line printing operation is started with step 537. Whether or not a ribbon cassette with an unused ink ribbon is present is checked by that print control FW 41, which checks the ribbon end flag from flip-flop 434 (STEPS 537 and 539). If the ribbon end flag is set to "1", the control sequence goes to step 600 and requires an operator of the system to exchange the ribbon cassette for a new one. In step 600, print control FW 41 sends a ribbon end status signal to CPU 10 indicating that no ribbon cassette with an unused ink ribbon is set. In response to the signal, CPU 10 displays a message requesting the operator to change the ribbon cassette (STEP 602). CPU 10 waits until the execute-key of keyboard unit 100 is pushed by the operator, and then commands print control FW 41 to execute steps 537 and 539 (STEP 604).

When the ribbon end f lag is not set in step 539, print control FW 41 sends the head down signal(DOWN) to head up/down control FW 45 (STEP 541). Next, FW 45 brings head support plate 313 down in the manner mentioned above.

A print operation by carriage control FW 43 is started. FW 43 reads the pattern data of a column out of line buffer 60 according to the address data stored in register 437, and sends heat signals (HEAT SIGNS.) to head 313*a* according to the read pattern data. The dot pattern of one column has now been printed on the sheet. After the contents of register 431 are decremented by one in step 545, the register 431 is checked. If it indicates a "0", that is, that the printing of the line has been finished, the control sequence goes to step 549 and the CPU 10 the CPU 10 is informed that the print operation for one line has been finished. If there are any other lines to be printed, the sequence from step 511 may be repeated. On the other hand, if the step number data stored in register 431 is not "0" in then step 547, step 551 is next step executed; carriage 311 is moved one step to the right while the used-up ribbon portion is simultaneously wound up one step by the reel in the ribbon cassette. Once the contents of register 433 and those of register 437 are both incremented by one (STEP 553), step 555 checks if the ink ribbon is used up. If unused ribbon portions remain in the cassette, the control sequence returns to step 543; if not, the step 557 through 577 are executed, causing the printing to be temporarily suspended in the middle of the one-line printing, and then resumed again from the printing stop position of the line once the exhausted ink ribbon is exchanged for a new one.

Figure 6B:
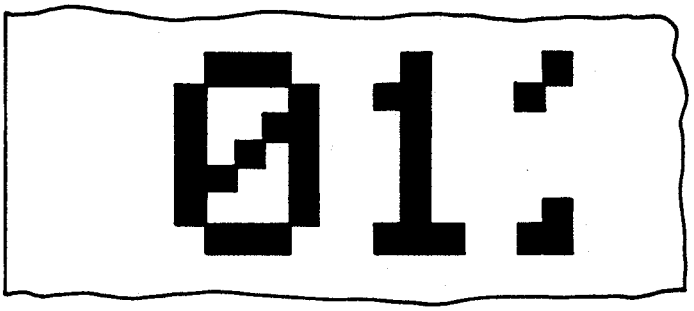
FIGS. 6B and 6C illustrate phases in the printing.
Figure 6C:
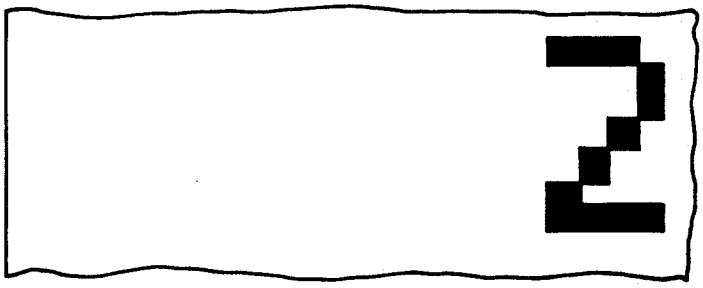
Figure 6D:
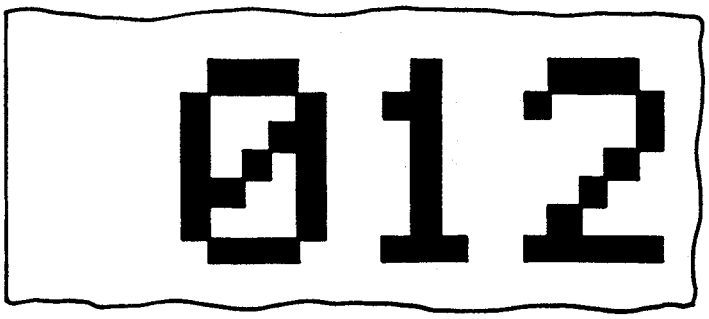
FIG. 6D illustrates a result of printing of the sample character patterns according to one aspect of the present invention.

In step 557, after carriage control FW 43 informs print control FW 41 that the printing of the line is suspended for the exchange of the ink ribbon cassette, FW 43 loads the contents of register 433 into register 413. The data now stored in register 413 indicates the printing stop position in the middle of the line where the carriage is not located. In the example shown in FIG. 6B, after the column dot pattern stored in the word of line buffer 60 addressed to [19] has been printed on the sheet and carriage 311 has been moved by one step to the right (the carriage position is now [20]), the ink ribbon is used up and the printing is stopped. Next, print control FW 43 brings head support plate 313 up by controlling head up/down control FW 45 (STEP 558). In step 559, the ribbon end status data and the ribbon end position data are sent back from print control FW 43 to CPU 10. When printing is restarted from the next column to be printed (e.g., column 20 in FIG. 6B), inaccurate placement of the printer mechanism tends to produce spaces or gaps in the printout. Therefore in the present embodiment the current position data is decremented by 1. (i.e. [19] in the example shown in FIG. 6B). Therefore, in printing the remaining portion of the line, the dot pattern for the last column printed before the ribbon ran out is printed over again on the same position on the sheet. CPU 10 stores the ribbon end position data [19] in this example sent to it from print control FW 41 in RAM 20 (STEP 561). In the next step, 563, CPU 10 sets carriage center position data indicating the substantial center of the whole scanning line by carriage 311 into start position data register 411. This step 563 is for moving carriage 313 to the center of a housing of the printer 30 so that the operator can easily change the used-up ink ribbon cassette. By execution of steps 565 through 571, carriage 311 is moved to the center of the printer housing. The operations by steps 565 to 571 are similar to those by steps 517 to 531, explained above. After carriage 311 is moved to the center position, CPU 10 displays the message, explained in step 602, requiring the operator to change the used-up ribbon casette for a new one (STEP 573). When the operator informs CPU 10 that the ribbon cassette has been changed by pushing the execute-key of keyboard 100 (STEP 575), CPU 10 sets the ribbon end position data (19) in RAM 20, stored in step 561, into start position data register 411. Then, returning to step 517, the printing is restarted. Since the data now stored in register 411 indicates the last column ([19] in the example) of the line where the dot pattern had been printed in the prior printing, the remaining dot patterns of the line shown in FIG. 6C will be printed by the present printing operations restarted from step 517. By subtracting one from the ribbon end position data in step 559, the dot patterns of the last printed column in the prior printing, are reprinted in the present printing, as shown in FIG. 6C. Therefore, as shown in FIG. 6D, the line dot patterns printed in the prior printing and the remaining line dot patterns printed in the resumed printing merge smoothly without any space.

As mentioned above, according to the invention, even when the ink ribbon is used up in the middle of printing a line in a document, the printing can be restarted without any change of the sheet, where parts of the document have been printed, after the used-up ink ribbon is changed for a new one.

In the above mentioned embodiments, CPU 10 sets the ribbon end position data into register 411 in STEP 577. In place of this step, the following modification may be applied as shown in FIG. 5F. When the ink ribbon is used up, print control FW 41 writes space data bits, all of which are zeros, into line buffer 60 starting from the word addressed in [0] to the column identified by the ribbon end position data which has been set at ([the current head position data]−1) in STEP 559 and corresponds to the last printed column. In the example shown in FIG. 6B, the contents of the words addressed in from 0 to 18 are replaced by the space data. In this case, the contents of register 411 need not be the ribbon end position data. Instead, the printing of the line is restarted from STEP 515 so that carriage 311 can be moved to the print start position of the entire line, and the printing is restarted from there. However, since the space data has been written in the prior printed portion of line buffer except for the last printed column, only the remaining portion shown in FIG. 6C is printed. As shown in FIG. 5G, the writing of the space data into line buffer 60 may be performed by carriage control FW 43 whenever carriage control FW 43 reads the pattern data from line buffer 60 and prints it. In this embodiment, since the printing (as shown in FIGS. 6B to 6D) performed by carriage control FW 43 resumes by printing the line from the head position the ribbon end position data is not required in the system, and with a "YES" branch of STEP 575 going to STEP 515, steps 559 561 and 577 can be eliminated.

Numerous modifications and variations of the present invention are possible in light of the above teachings. It is therefore to be understood that, within the scope of the appended claims, the present invention can be practiced in a manner other than as specifically described herein.

What is claimed is:

1. A processing system comprising:

memory means for storing columns of pattern data, each of which represent a dot image of a line to be printed;

printing means, using exchangeable printing material, for printing the pattern data stored in the memory means column by column, the printing means including detecting means for detecting when the printing material is used up and for producing a used-up signal indicative thereof; and control means for suspending operation of the printing means responsive to the used-up signal and for resuming operation of said printing means at a specified position after the printing material has been replaced, said specified position corresponding to a last column which said printing means has printed before the operation is suspended.

2. A processing system according to claim 1, further comprising storage means for storing used-up position data identifying said specified position, wherein said control means includes means for directing said printing means to start printing the pattern data at the specified position.

3. A processing system according to claim 2, wherein the printing means includes a printing head for printing a column of the pattern data and carriage means for moving the printing head along the line, and the control means includes means, responsive to said used-up signal, for directing the carriage means to move the printing head to a position where the used-up printing material can be easily exchanged.

4. A processing system according to claim 2, wherein the storage means stores the used-up position data corresponding to the last column which has been printed so that the last column is printed again when the control means resumes the printing of the pattern data.

5. A processing system according to claim 7, wherein said control means includes means for directing said printing means to start printing pattern data in said memory means at a start position of the line after the used-up printing material has been replaced so that said printing means prints only the remaining portion of the pattern data in said memory means from said specified position.

6. A processing system according to claim 5, wherein the printing means includes a printing head for printing a column of the pattern data and carriage means for moving the printing head along the line, and the control means includes means, responsive to said used-up signal, for directing the carriage means to move the printing head to a position where the used-up printing material can be easily exchanged.

7. A processing system according to claim 1, wherein said control means includes means for erasing pattern data in said memory means exclusive of the pattern data for columns following the specified position which has been printed.

8. A processing system according to claim 7, wherein the control means includes means for erasing a group of the pattern data when the pattern data for the group has been read out of the memory means to be printed.

9. A processing system according to claim 7, further comprising storage means for storing used-up position data identifying said specified position, and wherein said means for erasing erases the pattern data according to the used-up position data when the detecting means detects that the printing material is used up.

10. A processing system according to claim 9, wherein said storage means stores the used-up position data corresponding to the last column which has been printed.

11. A method for operating a printer having a printing head and exhaustible printing material so as to resume operation after used-up printing material has been replaced, comprising the steps of:

printing columns of pattern data stored in a memory, said columns of pattern data representing a dot image of a line;

suspending said printing step when the printing material is detected to be used up; and resuming said printing step from a specified position after the used-up printing material has been replaced, the specified position being a last column which the printer has printed before said printing step is suspended.

12. A method according to claim 11, wherein said step of erasing includes a step of erasing a group of the pattern data when the pattern data for the group has been read out of the memory means to be printed.

13. A method according to claim 11, further comprising a step of storing used-up position data identifying said specified position, and wherein the step of resuming includes a step of directing said printer to start printing the pattern data at the specified position after the used-up printing material has been replaced.

14. A method according to claim 13, wherein the step of resuming includes a step of printing the last group of the pattern data which as been printed according to the used-up position data.

15. A method according to claim 13, further comprising the steps of:

moving the printing head to a position where the used-up printing material can be easily replaced, and moving the printing head to the specified position corresponding to the used-up position data after the used-up printing material has been replaced.

16. A method according to claim 11, further comprising a step of erasing the pattern data in the memory exclusive of the pattern data for columns following the specified position which has been printed.

17. A method according to claim 16, further comprising a step of storing used-up position data identifying said specified position, and wherein said the step of erasing includes a step of erasing the pattern data according to the used-up position data.

18. A method according to claim 16, wherein said step of resuming includes a step of printing the last column of the pattern data which has been printed.

19. A method according to claim 16, wherein the step of resuming includes a step of directing the printer to start the printing step from the start position of the line after the used-up printing material has been replaced.

20. A method according to claim 19, further comprising steps of moving the printing head to a position where the used-up printing material can be easily replaced when the printing material is detected to be used up.

21. A method for operating a printer having a printing head and exhaustible printing material so as to resume after used-up printing material has been replaced, comprising the steps of:

printing groups of pattern data stored in a memory from a start position, said groups of pattern data representing a dot image of a line;

erasing specified ones of the groups of the pattern data in the memory which have been printed;

suspending said printing step when the printing material is detected to be used up; and resuming said printing step after the printing material has been replaced.

22. A method according to claim 21, further comprising a step of moving the printing head to the start position after the used-up printing material has been exchanged.

23. A method according to claim 21, further comprising a step of moving the printing head to a position where the used-up printing material can be easily replaced when the printing material is detected to be used up.

24. A method according to claim 21, wherein the step of erasing includes a step of erasing each of the specified ones of the groups of the pattern data when the specified one has been read out of the memory means to be printed.

25. A method according to claim 21, wherein the step of resuming includes a step of printing the last column of the pattern data which has been printed.

26. A method according to claim 25, wherein the step of erasing includes a step of erasing the specified ones of the groups of the pattern data that have been printed exclusive of the last column of the pattern data which has been printed, so that the last column is printed again in said resuming step.

27. A processing system comprising:

memory means for storing groups of pattern data which represent a dot image of a line to be printed;

printing means, using exchangeable printing material, for printing the pattern data stored in the memory means group by group, the printing means including detecting means for detecting when the printing material is used up and for generating a used-up signal in response thereto;

control means for erasing specified ones of the groups of the pattern data in the memory means which have been printed and, responsive to the used-up signal, for suspending operation of the printing means, so that the used-up material can be replaced, and for enabling operation of the printing means to continue printing of the groups of the pattern data when the printing material has been replaced.

28. A processing system according to claim 27 further comprising storage means for storing used-up position data identifying the position of the group where the printing has stopped, and the control means erases the specified ones of the groups of the pattern data which have been printed in the memory means according to the used-up position data.

29. A processing system according to claim 27, wherein the control means erases a group of the pattern data when the pattern data for the group has been read out of the memory means for printing.

30. A processing system according to claim 27 wherein the printing means including a printing head for printing a group of the pattern data, and carriage means for moving the printing head along the line, and the control means directs the carriage means to move the printing head to a position where the used-up printing material can be easily exchanged after the detection of the using-up of the printing material and to move the printing head to a start position of the line after the used-up printing material has been replaced.

31. A method for operating a printer having a printing head and exhaustible printing material so as to resume after used-up printing material has been replaced, comprising the steps of:

printing groups of pattern data stored in a memory from a start position, said groups of pattern data representing a dot image of a line;

suspending said printing step when the printing material is detected to be used up;

erasing specified ones of the groups of the pattern data in the memory means which have been printed according to a position of said printing head when said printing step is suspended; and resuming said printing step after the used-up printing material has been replaced.

32. A method according to claim 31, further comprising a step of moving the printing head to the start position after the used-up printing material has been exchanged.

33. A method according to claim 31, further comprising a step of moving the printing head to a position where the used-up printing material can be easily replaced when the printing material is detected to be used up.

34. A printing processing system comprising:

memory means for storing groups of pattern data which represent a dot image of a line to be printed;

printing means, using exchangeable printing material, for printing the pattern data stored in the memory means group by group, the printing means including detecting means for detecting when the printing material is used up and for generating a used-up signal in response thereto;

control means for erasing specified ones of the groups of the pattern data in the memory means which have been printed and, responsive to the used-up signal, for suspending operation of the printing means, so that the used-up material can be replaced, and for enabling operation of the printing means to continue printing of the groups of the pattern data when the printing material has been replaced; wherein said control means comprises means for erasing the groups of the pattern data in the memory means that have been printed exclusive of the last column of the pattern data which has been printed, so that the last column is printed again when the control means resumes the printing of the columns of the pattern data.

35. A method for operating a printer having a printing head and exhaustible printing material so as to resume after used-up printer material has been exchanged, comprising the steps of:

printing columns of pattern data stored in a memory from a start position, said columns of pattern data representing a dot image of a line;

suspending said printing step when the printing material is detected to be used up;

erasing specified ones of the columns of the pattern data in the memory means which have been printed according to a position of said printing head when said printing step is suspended;

moving the printing head to a position where the used-up printing material can be easily replaced; and resuming said printing step;

wherein said erasing step comprises a step of erasing the specified ones of the groups of the pattern data in the memory that have been printed exclusive of the last group of the pattern data which has been printed and a step of printing the last column group again.

* * * * *